US005402328A

United States Patent [19]

Pardo

[11] Patent Number: 5,402,328

[45] Date of Patent: Mar. 28, 1995

[54] LAMP

[75] Inventor: Pablo E. Pardo, San Francisco, Calif.

[73] Assignee: Westinghouse Electric Corporation, Pittsburgh, Pa.

[21] Appl. No.: 99,816

[22] Filed: Jul. 29, 1993

[51] Int. Cl.[6] ..... F21V 21/14

[52] U.S. Cl. ..... 362/413; 362/255; 362/319; 362/414

[58] Field of Search ..... 362/319, 255, 256, 351, 362/350, 382, 410, 412, 414, 418, 419, 413

[56] References Cited

U.S. PATENT DOCUMENTS

| | | | |
|---|---|---|---|
| D. 205,081 | 6/1966 | Cousins et al. | D48/20 |
| 732,211 | 6/1903 | Mygatt | 362/255 |
| 2,806,131 | 9/1957 | Palmer | 362/186 |
| 4,706,172 | 11/1987 | Lebowitz | 362/270 |
| 4,974,135 | 11/1990 | Wen-Tsung | 362/287 |
| 4,974,139 | 11/1990 | Chin-Song | 362/418 |
| 5,001,617 | 3/1991 | Chan | 362/401 |
| 5,045,986 | 9/1991 | Lin | 362/413 |
| 5,134,555 | 7/1992 | Messana | 362/382 |

*Primary Examiner*—Stephen F. Husar

[57] ABSTRACT

Disclosed is an adjustable lamp assembly especially suitable for use as a table or desk lamp. The lamp assembly has a substantially spherical or conical base member having an adjustable center of gravity which allows it to be moved and retained in a variety of inclined and tilted positions. Also disclosed is a lamp assembly having a concave shade member having a peripheral rim and a central opening adapted to rest upon and be supported freely on the curved outer surface of a lamp bulb globe whereby the peripheral rim of the shade member will remain in a horizontal plane as the lamp assembly is tilted relative to the horizontal plane.

24 Claims, 4 Drawing Sheets

LAMP

BACKGROUND OF THE INVENTION

This invention relates to an adjustable lamp assembly. It relates particularly to a table or desk lamp that is easily adjusted by the user to an inclined or tilted position to direct the light source as needed or to an inclined or tilted position for decorative or aesthetic effects.

Table lamps are usually made with a fixed decorative base designed to rest upon a horizontal table top or similar surface. A table lamp is usually not adjustable, except for light intensity, to either specifically direct the light source or for decorative or aesthetic effects. Desk lamps are usually made with a fixed functional base designed to sit upon or be attached to a horizontal desk top or similar work station surface. Desk lamps are frequently adjustable to allow the user to direct the light source to a specific work area on the surface of the desk or work station. Desk lamp adjustments usually are made by an adjustable shade or by an adjustable support arm. Most adjustable desk lamps are primarily functional and lack aesthetic appeal.

SUMMARY OF THE INVENTION

It is therefore an object of this invention to provide an adjustable lamp assembly, especially suitable for use as a table or desk lamp, that can be easily adjusted by the user to an inclined or tilted position to direct the light source as needed or to an inclined or tilted position for decorative or aesthetic effects.

It is another object of this invention to provide an adjustable lamp assembly that provides a variety of both functional lighting and decorative effects.

It is a further object of this invention to provide an adjustable lamp assembly that is simple to manufacture and operate.

It has been discovered that the foregoing objects can be attained by an adjustable lamp assembly comprised of a base member having an adjustable center of gravity, an elongated neck member secured at one end to the top of the base member and having at the other end a lamp socket and a lamp bulb globe having a curved outer surface and a concave shade member having a peripheral rim and a central opening adapted to rest upon and be supported freely on the curved outer surface of the lamp bulb globe whereby the peripheral rim of the shade member remains in a horizontal plane as the lamp assembly is inclined or tilted relative to the horizontal plane.

DESCRIPTION OF THE PREFERRED EMBODIMENTS

Figure 1:
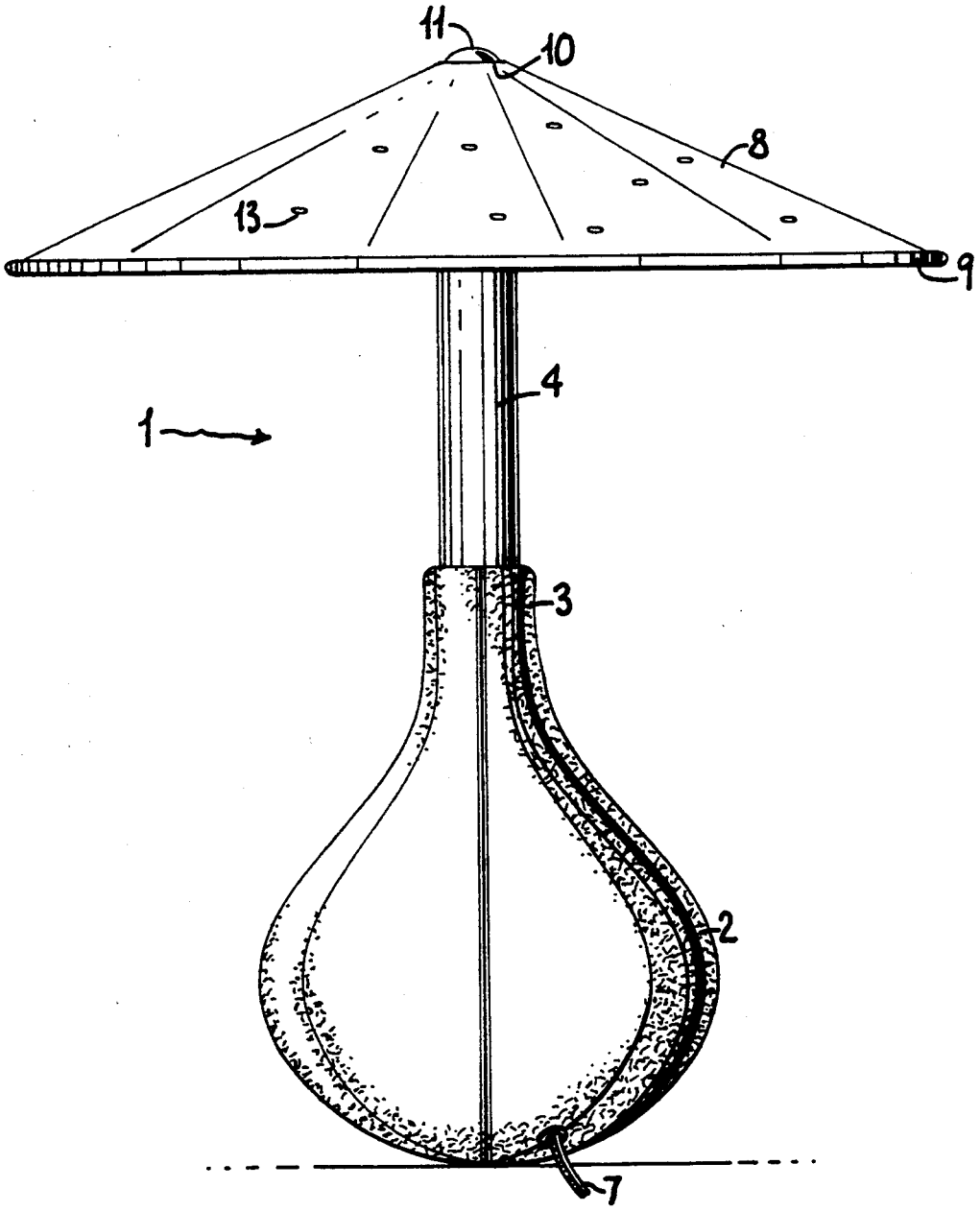
FIG. 1 is a front elevational view of a table lamp illustrating a first embodiment of the adjustable lamp assembly of this invention.

FIG. 1 is a front elevational view of a table lamp illustrating a first embodiment of the adjustable lamp assembly 1 of this invention. As shown in FIG. 1, the lamp assembly 1 is comprised of a substantially spherical base member 2 with a hollow interior filled with a movable mass or ballast and having an upper collar portion 3 surrounding the lower end of a tubular neck member 4. The upper end of the tubular neck member contains either a conventional incandescent or halogen lamp bulb socket 5 and a lamp bulb globe 6. An electrical line cord 7 having a switch (not shown) enters through an opening in the base member 2 and passes up through the tubular neck member 4 to the lamp bulb socket 5. A shade member 8, that is concave internally relative to the lamp bulb globe 6, having a peripheral rim 9 and a central opening 10 whose diameter is slightly less than the diameter of the curved outer surface 11 of the lamp bulb globe 6 is supported freely on the curved outer surface 11 of the lamp bulb globe 6.

In this embodiment of the invention, illustrated in FIGS. 1–6, the base member 2 with its upper collar portion 3 and spherical base portion resembles a boxer's "punching bag" in appearance, especially since in this embodiment, the base member 2 is made of six leather segments sewed together. If desired, the upper collar portion 3 may be provided with a zipper or other suitable fastener, to allow access to the hollow interior of the base member 2. The base member 2 may be also be made of other materials, preferably pliable materials, such as a leather-like fabric or plastic, and from any number of segments sewed together. It is also possible, although not preferred, to make the base member 2 of a rigid or semi-rigid material, such as plastic, metal or a ceramic. While the embodiment of this invention illustrated in FIG. 1, shows a smooth leather outer surface for the base member 2, the outer surface of base member 2 could also be faceted or textured, if desired.

Figure 2:
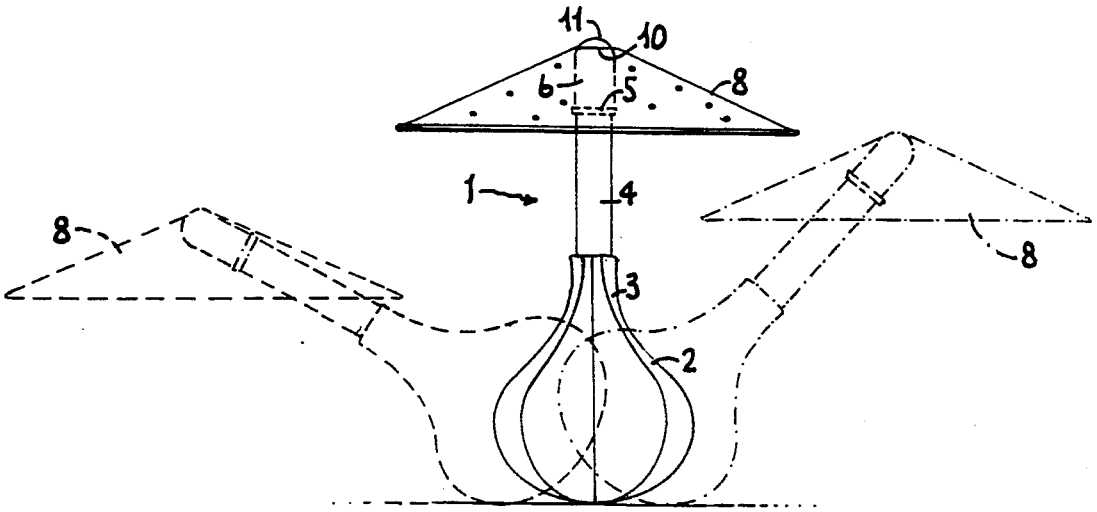
FIG. 2 is front elevational view similar to FIG. 1, illustrating a first embodiment of the adjustable lamp assembly of this invention in a vertical upright position and, in phantom dashed lines, in two inclined or tilted positions.
Figure 3:
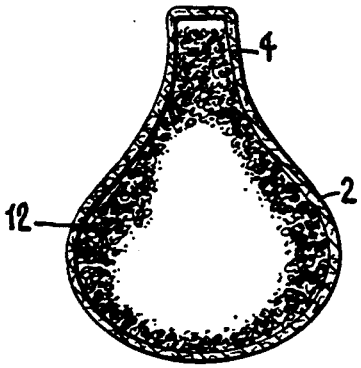
FIGS. 3 and 4 are sectional views of the base member of the adjustable lamp assembly of this invention illustrating a means of adjusting the center of gravity of the base member to allow the lamp assembly to be placed in an inclined or tilted position.
Figure 4:
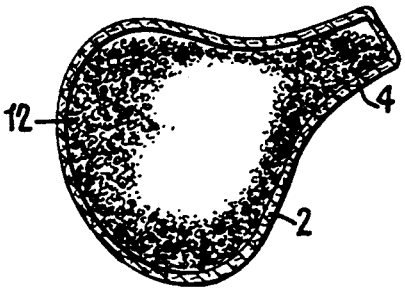

The base member 2 has most of its hollow interior filled with a movable mass 12 or ballast comprised preferably of pellets or shot-like particles, as illustrated in FIGS. 3 and 4. While this embodiment uses a mixture of plastic pellets and metal shot-like punchings as the movable mass 12 or ballast, other materials such as sand, a heavy gel or other materials, having a specific gravity of at least one, could be used. The movable mass 12 or ballast in the base member 2, allows the center of gravity of the base member 2 to shift as the base member 2 is inclined or tilted, as illustrated in FIGS. 2 and 4. The shiftable center of gravity of the base member 2, allows the base member 2 and the lamp assembly 1 to be easily adjusted by the user into a wide range of inclined or tilted positions to either direct the light source as needed or for decorative or aesthetic effects. The mass 12 or ballast will hold the base member 2 and the lamp assembly 1 in the desired inclined or tilted position until repositioned by the user. FIG. 2 illustrates the first embodiment of the lamp assembly 1 of this invention in a vertical upright position and, in phantom dashed lines, two inclined or tilted positions.

As described above, and illustrated in FIG. 1, the bottom end of the elongated tubular neck member 4 fits within the upper collar portion 3 of the base member 2 and allows the user to tilt the lamp assembly to the desired position. In the first embodiment of this invention, the neck member 4 is made of tubular metal, but it could be substantially solid, except for a line cord channel and made of plastic or wood or materials other than metal, if desired. While FIG. 1 illustrates a table lamp as one of the preferred embodiments of this invention, the lamp assembly 1 of this invention could also be a floor lamp by making the elongated neck member 4 of a longer length.

Figure 5A:
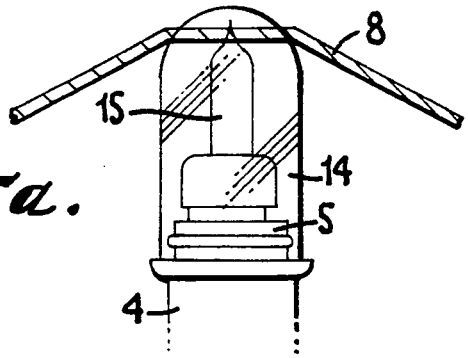
FIGS. 5*a*, 5*b* and 5*c* are enlarged views of to illustrate the relationship of the shade member relative to the lamp bulb globe in several inclined or tilted positions of the adjustable lamp assembly of this invention.
Figure 5B:
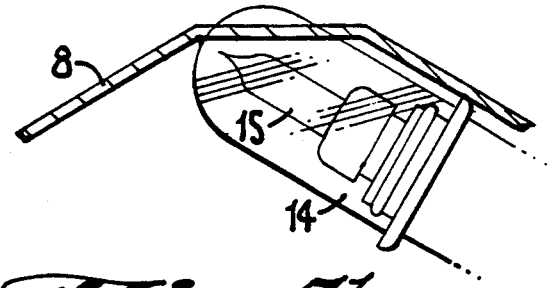
Figure 5C:
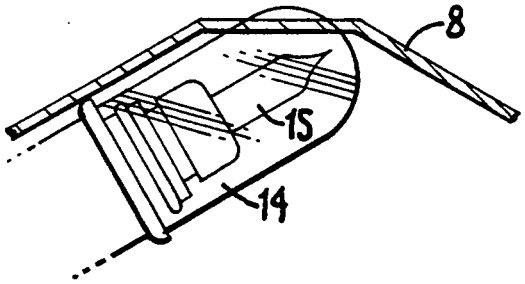
Figure 6:
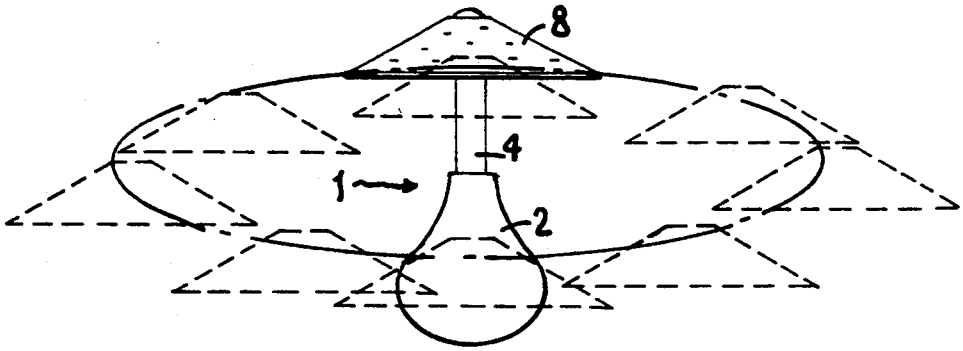
FIG. 6 is an elevational view of a first embodiment of the adjustable lamp assembly of this invention to illustrate, in phantom dashed lines, a variety of inclined or tilted positions possible with the lamp assembly of this invention.

As illustrated in FIGS. 1, 2, 5*a*, 5*b* and 5*c*, the lamp assembly 1 of this invention is provided with a unique and novel concave shade member 8 having a peripheral rim 9 and a central opening 10 designed so that the inner concave surface rests upon and is supported freely on the curved outer surface 11 of the lamp bulb globe 6. As best illustrated in FIGS. 2, 5*a*, 5*b* and 5*c*, this arrangement allows the peripheral rim 9 to always remain in a horizontal plane as the lamp assembly 1 and lamp bulb 6 are inclined or tilted relative to a horizontal plane. As a result, there is no need for the user to additionally adjust the shade member 8 to accommodate the various positions of the lamp assembly 1, which was often the case in prior table and desk lamps. The central opening 10 is preferably circular and is of a diameter slightly less than the diameter of the curved outer surface 11 of the lamp bulb globe 6. The lamp bulb globe 6 can be a glass incandescent lamp bulb globe that encloses the filament or it can be a separate cylindrical glass globe 14 with a spherical top that fits over and encloses a smaller halogen lamp bulb 15, as shown in FIGS. 5*a*, 5*b* and 5*c*, if desired. As shown in FIG. 1, shade member 8 in this embodiment is also provided with a plurality of randomly spaced small perforations 13, which produce a pleasing aesthetic effect. In the preferred embodiments of this invention, the shade member 8 is a truncated conical shape, made of spun aluminum or brass, but could be of other concave shapes and made of other materials, such as a heat resistant plastic or a wire frame covered with a fabric.

A specific example of the first table lamp embodiment of the lamp assembly of this invention, illustrated in FIG. 1, had a six segment soft leather base member 2 having a spherical diameter of about 5 inches (12.7 cm.) in diameter with the top of the upper collar portion 3 about 6.5 inches (16.5 cm.) above the bottom of the base member 2. The neck member 4 was an aluminum tube having a 0.875 inch (2.2 cm.) outer diameter and extended about 4 inches (10 cm.) above the top of the upper collar portion 3. The lamp bulb socket contained a twenty-five watt, Model No. GE-25T8C lamp bulb globe 6 manufactured by General Electric Company and others. Alternatively, a halogen bi-pin socket and a thirty five watt Model JC twelve volt bi-pin halogen lamp bulb 15 of the type manufactured by Shogyo International, Great Neck, N.Y. and a cylindrical bulb cover globe 14 manufactured by Chemglass Inc., Vineland, N.J. was used in this embodiment, which also required a twelve volt transformer in the line cord to supply twelve volts to the halogen lamp bulb 15. The truncated conical shade member 8 was made of spun aluminum and had a central opening 10 of about 0.8 inches (2 cm.) and an outer peripheral rim diameter of about 10 inches (25 cm.). The base member 2 was filled with approximately eight pounds (3.6 kg.) of a mixture of high density polyethylene pellets and perforated metal shot-like punchings having a combined specific gravity of greater than one. The complete lamp assembly 1, when in a vertical upright position, extended about 12.2 inches (31 cm.) inches above the table top.

Figure 7:
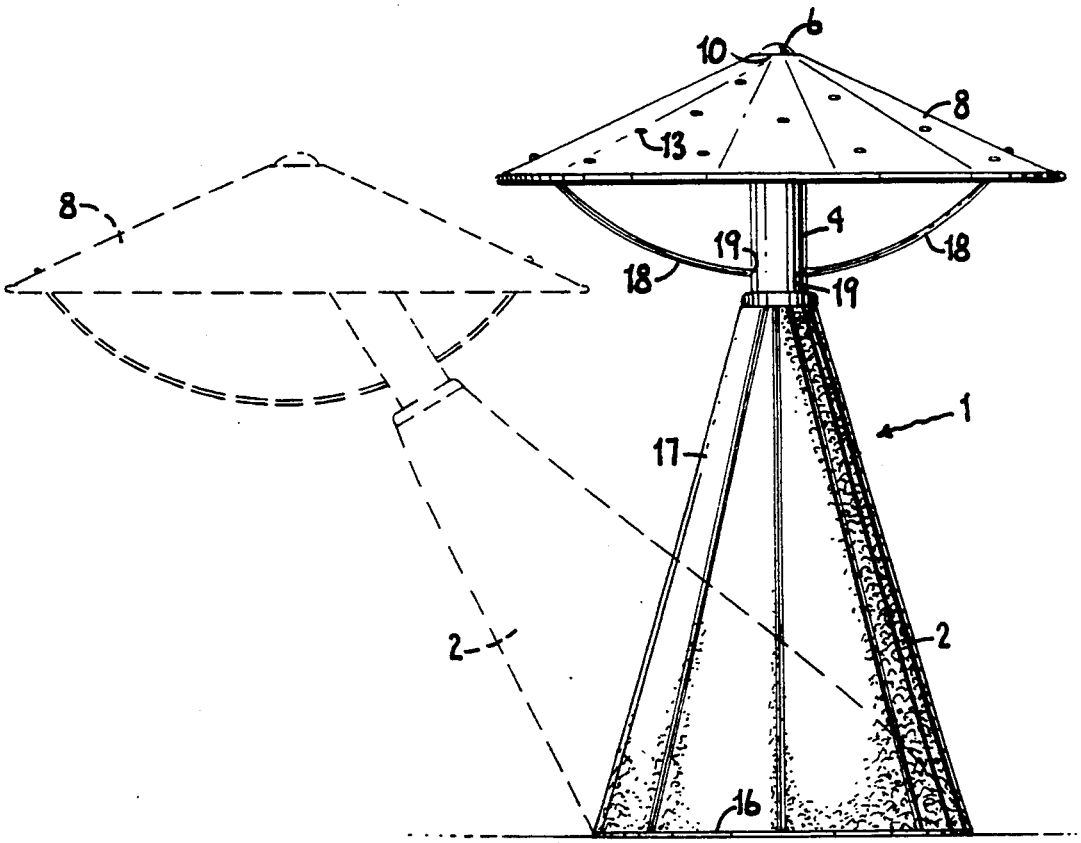
FIG. 7 is a front elevational view of a second embodiment of the adjustable lamp assembly of this invention in a vertical upright position and, in phantom dashed lines, in an inclined or tilted position.

FIG. 7 illustrates a second embodiment of the adjustable lamp assembly 1 of this invention in a vertical, upright position and, in phantom dashed lines, in an inclined or tilted position. In this embodiment, the base member 2 is substantially conical in shape with a substantially flat metal base portion 16 and a conical upright portion 17 made of soft leather segments sewed together. This second embodiment also illustrates an optional feature for the lamp assembly 1 of this invention in which a thin flexible cable assembly 18 extends through a pair of openings 19 in the neck member 4 with the ends of the cable assembly 18 secured to diametrically opposite sides of the peripheral rim 9 of the concave shade member 8. The cable assembly 18, not only prevents the concave shade member 8 from accidently falling off the lamp bulb globe 6 during use, but also allows for a more precise adjustment and retention of the concave shade member 8, when the lamp assembly 1 is inclined or tilted.

While I have described this invention by illustrating and describing the preferred embodiments of it, I have done this by way of example, and am not to be limited thereby, as there are modifications and adaptions of these embodiments that could be made within the scope of this invention.

I claim:

1. An adjustable lamp assembly comprising a base member having an adjustable center of gravity, an elongated neck member secured at one end to the top of the base member and having at the other end a lamp socket and a lamp bulb globe having a curved outer surface and a concave shade member supported freely on the curved outer surface of the lamp bulb globe.

2. The lamp assembly of claim 1 adapted to rest upon a desk or table top.

3. The lamp assembly of claim 1 in which the shade member is a truncated conical shape.

4. The lamp assembly of claim 1 in which the shade member is made of metal.

5. The lamp assembly of claim 1 in which the shade member is provided with a plurality of perforations.

6. The lamp assembly of claim 1 in which the shade member is provided with a peripheral rim.

7. The lamp assembly of claim 1 in which the shade member is provided with a central opening whose diameter is less than the diameter of the curved outer surface of the lamp bulb globe.

8. The lamp assembly of claim 1 in which the base member is substantially spherical in shape.

9. The lamp assembly of claim 1 in which the base member is substantially conical in shape.

10. The lamp assembly of claim 1 in which the base member is made of a pliant material.

11. The lamp assembly of claim 1 in which the base member is made of leather.

12. The lamp assembly of claim 1 in which the base member is made of several segments fastened together.

13. The lamp assembly of claim 1 in which the base member has an upper collar portion surrounding one end of the neck member.

14. The lamp assembly of claim 1 in which the base member is filled with pellets or shot-like particles.

15. The lamp assembly of claim 1 in which the base member is filled with a movable mass having a specific gravity of at least 1.

16. The lamp assembly of claim 1 in which the neck member is tubular.

17. The lamp assembly of claim 1 in which a cable assembly passes through a pair of openings in the neck member and is attached to diametrically opposite sides of the peripheral rim of the concave shade member.

18. A concave shade member for a lamp having a peripheral rim and a central opening adapted to rest upon and be supported freely on the curved outer surface of a lamp bulb globe whereby the peripheral rim of the shade member remains in a horizontal plane as the lamp is tilted relative to the horizontal plane.

19. The concave shade member of claim 18 in which the diameter of the central opening is less than the diameter of the curved outer surface of the lamp bulb globe.

20. The concave shade member of claim 18 in which the shade member is a truncated conical shape.

21. The concave shade member of claim 18 in which the shade member is made of metal.

22. The concave shade member of claim 18 in which the shade member is provided with perforations.

23. The concave shade member of claim 18 in which the shade member is provided with a peripheral rim.

24. The concave shade member of claim 23 in which a cable assembly is secured to diametrically opposite sides of the peripheral rim.

* * * * *